United States Patent [19]

Abell et al.

[11] 4,021,875

[45] May 10, 1977

[54] PIVOTABLE AND EXTENSIBLE TENSION POST FOR A CABLE BRIDGE STRUCTURE

[75] Inventors: William Ray Abell, Fairfax County, Va.; Philip Stanley Bulson; Robin Trench Weld, both of Christ Church, England

[73] Assignee: The United States of America as represented by the Secretary of the Army, Washington, D.C.

[22] Filed: Apr. 10, 1975

[21] Appl. No.: 566,849

[52] U.S. Cl. ..... 14/10; 182/218; 52/640

[51] Int. Cl.[2] ..... E01D 15/12

[58] Field of Search ..... 14/10, 9; 52/640, 641; 182/218

[56] References Cited

UNITED STATES PATENTS

| | | | |
|---|---|---|---|
| 197,324 | 11/1877 | Boynton | 182/218 X |
| 459,301 | 9/1891 | Murphy | 14/10 |
| 665,780 | 1/1901 | Hayward | 182/218 |
| 976,074 | 11/1910 | Hartman | 182/218 X |
| 1,142,955 | 6/1915 | Gaw | 182/218 X |
| 2,183,015 | 12/1939 | Foulds | 52/640 X |

*Primary Examiner*—Nile C. Byers
*Attorney, Agent, or Firm*—Nathan Edelberg

[57] ABSTRACT

This invention relates to bridge sections and is particularly concerned with bridge sections of the type which incorporates tensioned cables to reinforce the structure of the bridge sections. The cables are tensioned to provide a bowstring truss section in the completed bridge.

3 Claims, 2 Drawing Figures

PIVOTABLE AND EXTENSIBLE TENSION POST FOR A CABLE BRIDGE STRUCTURE

In known cable reinforced bridge structures, the attachment and tensioning of the cable reinforcement and the erection of the necessary king or queen posts which transmit the tensile forces in the cable to the bridge structure, can take a considerable time and present constructional difficulties. Such problems can become serious when dealing with temporary bridges particularly in the military field where such arrangements are commonly employed and where time is a very important consideration. The present invention therefore provides a bridge arrangement which reduces the difficulties and the time of construction of such a bridge and in which the cables and king or queen posts are mounted on the bridge structure so as to be transported and launched with it, erection of the posts and tensioning of the cables being carried out mechanically.

The invention consists of a bridge arrangement incorporating a bridge structure having at least one tensioning cable attached thereto at two longitudinally spaced points; at least one king or queen post pivoted to the structure at a location between the said spaced points, an end of the said post spaced from the pivot engaging the cable and moveable therealong; and means for rotating the post about its pivot into its operative position to tension the cable.

A single king post or several queen posts may be used according to the length of span and the support required.

A variety of means will occur to those skilled in the art for rotating the post but one very suitable means, which readily lends itself to operation by remote control, comprises a hydraulic ram connected one end to the bridge structure and the other to the post at a point spaced from the pivot whereby extension or retraction of the ram will rotate the post.

It is, further, convenient to incorporate in the post or posts, means for adjusting the tension of the cable. One suitable arrangement for achieving this is a telescopically extensible post which can be extended or retracted hydraulically or mechanically to vary the cable tension. Alternatively a tensioning device may act on the cable itself in which case, of course, the post need not, itself, be extensible.

One form of the invention will now be more particularly described with reference to the accompanying drawings in which.

Figure 1:
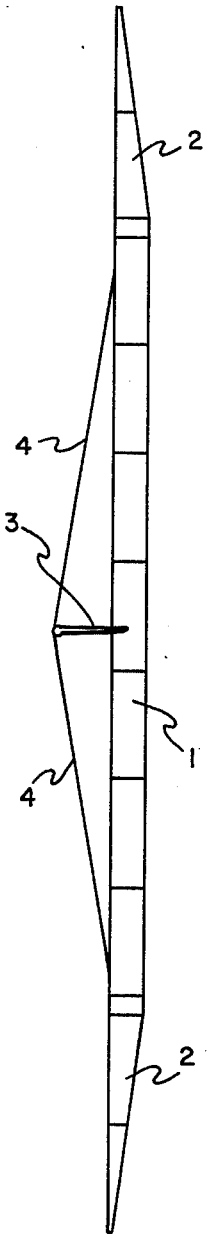
FIG. 1 is a diagrammatic representation of a bridge arrangement.

As shown in FIG. 1 a bridge span 1 to which are attached end ramps 2 is emplaced across a gap and a single king post 3 is shown erected centrally on the span. A reinforcing cable 4 extends from one end to the other of the span 1 and is engaged at its centre by the lower end of the king post 3 which transmits the tensile forces in the cable to the centre of the span to provide additional support for the bridge.

Figure 2:
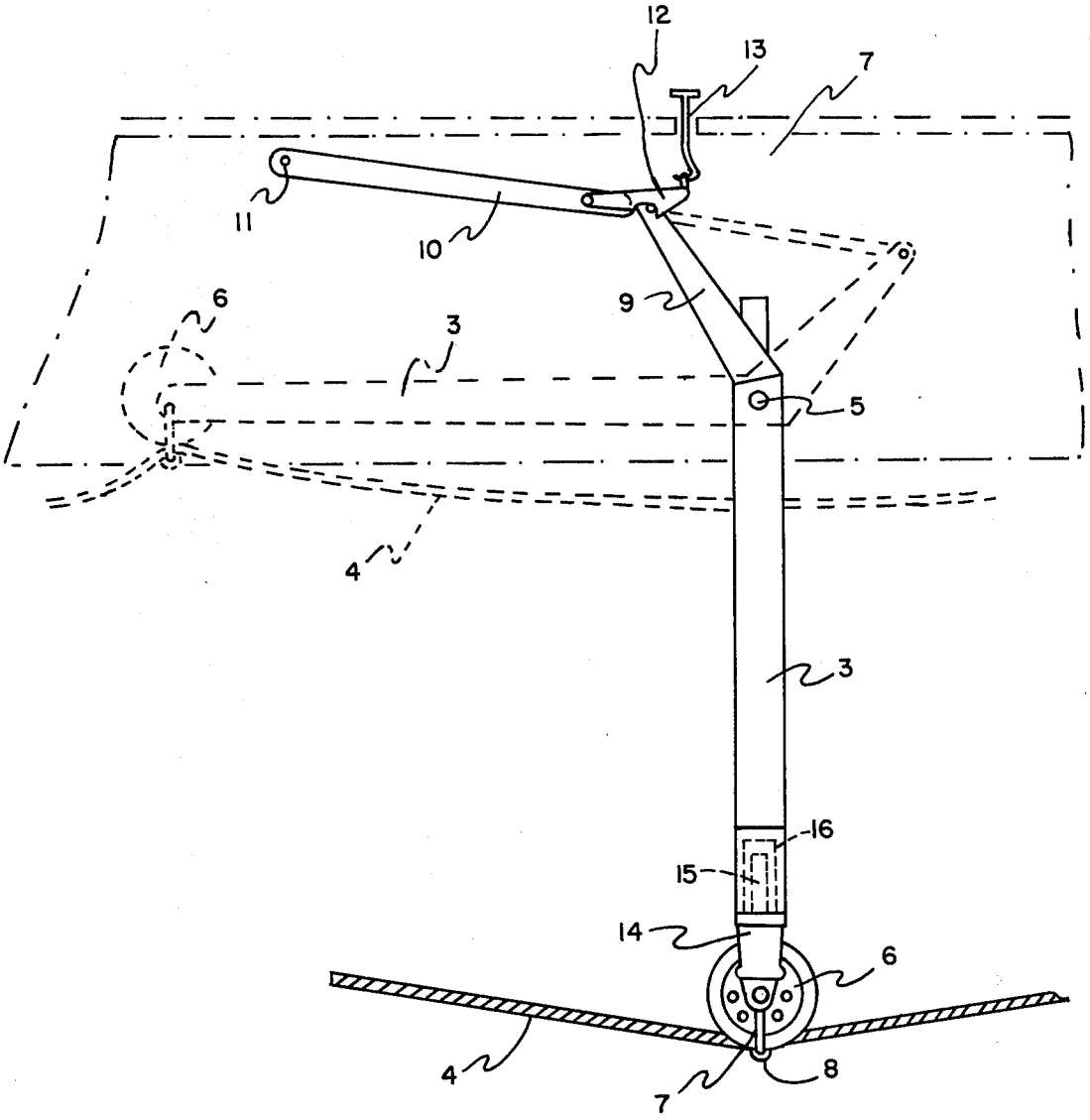
FIG. 2 is a detail showing the construction of a king post

The king post 3 as shown in FIG. 2 is rotatably attached to the bridge span 1 (shown schematically by chain dotted lines) by a pivot 5 and can swing between a stowed position, shown in dotted outline, and an erected position in which it extends downwardly below the span 1. The post 3 carries at its end remote from the pivot 5, a pulley 6 which engages the tensioning cable 4. The cable is retained with the pulley by a loop 7 pivoted on the pulley axle and carrying a small roller 8 bearing on the outer portion of the cable 4. The king post 3 has attached thereto or integral therewith a shorter arm 9 extending from the vicinity of the pivot on the side thereof remote from the main post 3. The outer end of arm 9 is connected to the ram of a hydraulic jack 10 which is mounted on the bridge span 1 by a pivot 11.

It will be seen that extension of the jack 10 raises the king post 3 and the cable 4 into the stowed position (shown dotted) where the post 3 lies within the boundaries of the span 1 with the cable 4 extending loosely along the lower surface of the span. Retraction of the jack 10 automatically erects the king post 3 to its operative position where the cable 4 is properly positioned and in tension. The length of the cable is, of course, suitably chosen for this purpose. If desired, a spring loaded locking catch 12 may be provided to lock the king post 3 in its erect position and thus relieve the stress on the jack 10. The catch may be releasable by hand, for example by the use of a lifting hook 13.

If desired, in order to increase the permissible tolerance on cable length and to allow for possible stretching of the cable the king post 3 may be extensible. This may be arranged by attaching the end portion 14 of the post to the ram 15 of a mechanical or hydraulic jack 16 mounted in or on the post so that extension of the jack will move the portion 14 of the post 3, and the pulley 6 which is mounted thereon, downward to apply additional tension to the cable 4.

An arrangement such as herein described can be transported as a unit with the king post in the stowed position and the cable already attached. The unit can then be launched, still in the stowed position and thereafter, the king post can be swung into its operative position to deploy and tension the cable, further tension being applied if necessary by extension of the post. Erection of such a bridge structure is clearly simpler and quicker than would be the case where posts and cable have to be attached after emplacement of the span. Furthermore the cable may be attached to any desired points along the structure since problems of accessibility of attachment points after emplacement do not arise.

Clearly, instead of a single king post, a pair of queen posts or other multiple supporting post arrangements may be used and it will be clear to those skilled in the art that many other details of this arrangement can be varied while remaining within the broad scope of this invention.

What is claimed is:

1. A bridge structure having at least one tensioning cable attached thereto at two longitudinally spaced points, at least one post pivoted to said bridge structure at a location between said spaced points, an end of said post spaced from the pivot connection to said bridge structure adapted to engage the cable and movable therealong; means associated with and attached to said bridge structure and said post for rotating said post about the pivot connection to said bridge structure into its operative position, said operative position being substantially perpendicular to the span of said bridge structure; and means associated with and attached to said post for extending the length of said post such that said post places said tensioning cable under tension condition.

2. A bridge structure as defined in claim 1 wherein said means for extending is a hydraulic extension means.

3. A bridge structure as defined in claim 1 wherein said means for extending is a telescopic assembly and said end of said post movable on said cable is attached to an extensible section of said telescopic assembly.

* * * * *